US006363758B1

(12) United States Patent
Ling

(10) Patent No.: US 6,363,758 B1
(45) Date of Patent: Apr. 2, 2002

(54) ERGONOMICALLY MANIPULATED CABLE COMBINATION LOCK WITH LAY-OUT OPERATIONS IN ANGULAR RELATIONSHIP

(76) Inventor: Chong-Kuan Ling, 11F, No. 27, An-Ho Road, Sec. 1, Taipei (TW), 106

( * ) Notice: Subject to any disclaimer, the term of this patent is extended or adjusted under 35 U.S.C. 154(b) by 0 days.

(21) Appl. No.: 09/551,971

(22) Filed: Apr. 11, 2000

(51) Int. Cl.[7] ..... E05B 37/06; E05B 37/18
(52) U.S. Cl. ..... 70/30; 70/22
(58) Field of Search ..... 70/30, 20, 22, 70/49

(56) References Cited

U.S. PATENT DOCUMENTS 2,933,915 A * 4/1960 Gossner ..... 70/49
5,156,028 A * 10/1992 Jiang ..... 70/30
5,560,232 A * 10/1996 Chen ..... 70/30
5,868,012 A * 2/1999 Chun-Te et al. ..... 70/30

* cited by examiner

*Primary Examiner*—Yonel Beaulieu

(57) ABSTRACT

An ergonomically manipulated cable combination lock includes: a housing, a cable or wire having one cable end fixed in a first hole in the housing and having another cable end secured with a locking plug lockable in a second hole in the housing, a plurality of dials and sleeves rotatably mounted on a bolt in the housing, and a control device having a push button pivotally secured in the housing and a sliding actuator normally locking the plug of the cable in the housing and operatively depressing the bolt for unlocking the plug upon depression of the push button, with the plug inserted in the housing to be angularly separated from the bolt in an acute angle to provide enough space for accommodating all the relevant elements within the housing and also to allow a single-hand operation when holding the housing and depressing the push button for ergonomically unlocking the lock by a single hand of the user.

6 Claims, 7 Drawing Sheets

ERGONOMICALLY MANIPULATED CABLE COMBINATION LOCK WITH LAY-OUT OPERATIONS IN ANGULAR RELATIONSHIP

BACKGROUND OF THE INVENTION

U.S. Pat. No. 5,868,012 disclosed a chain lock having a flexible wire lockable on a locking body for locking motorcycle, bicycle and travelling certificates.

However, such a chain or wire lock has the following drawbacks:

1. Once the travelling certificates including passport, air ticket and so on are locked on the wire (20) of the chain lock, an unlocking operation will be obstructed by the articles as locked on the wire because the wire end with the obturator (23) should be pulled outwardly (from FIG. 2 to FIG. 3 of the prior art) to eject the plug (21) at another end of the wire (20) in order to unlock the combination lock.
2. When rotating the dials (121) to a correct unlocking combination to align each notch (125) in each sleeve (122) with the protrusion (132) of the slide (13), but not yet engaged, as shown in FIG. 2 of the prior art, it should be very careful to hold the lock without moving the dials until pulling the obturator (23). Any unexpected accidental movement of the lock may unalign the notch (125) of the sleeve from the protrusion (132) of the slide, thereby obstructing the unlocking operation.
3. For unlocking operation, the user has his or her one hand holding the locking body and having another hand pulling the obturator of the wire. Two hands should simultaneously operate to cause inconvenience.
4. Two wire ends (21, 23) are separated in a right angle and are respectively connected to two sides of a rectangular locking body, which may form a blockade obstructing the holding of the locking body and may cause inconvenience for locking or unlocking the lock.

The present inventor has found the drawbacks of the conventional wire lock and invented the ergonomically manipulated cable combination lock.

SUMMARY OF THE INVENTION

The object of the present invention is to provide an ergonomically manipulated cable combination lock including: a housing, a cable or wire having one cable end fixed in a first hole in the housing and having another cable end secured with a locking plug lockable in a second hole in the housing, a plurality of dials and sleeves rotatably mounted on a bolt in the housing, and a control device having a push button pivotally secured in the housing and a sliding actuator normally locking the plug of the cable in the housing and operatively depressing the bolt for unlocking the plug upon depression of the push button, with the plug inserted in the housing to be angularly separated from the bolt in an acute angle to provide enough space for accommodating the relevant elements within the housing and also to allow a single-hand operation when holding the housing and depressing the push button for ergonomically unlocking the lock by a single hand of the user.

DETAILED DESCRIPTION

Figure 1:
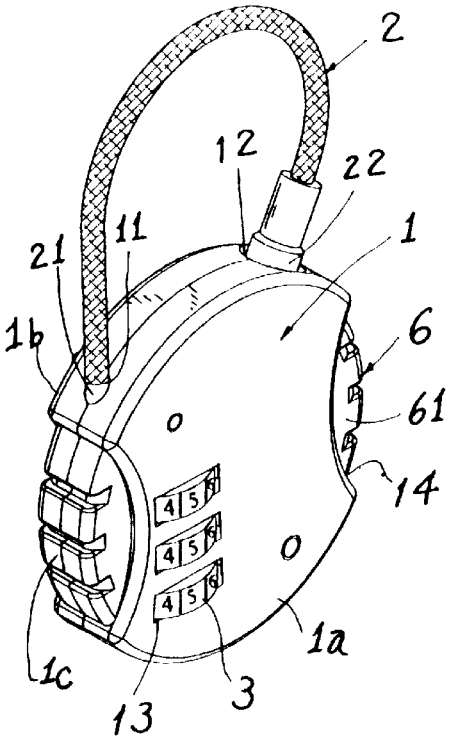
FIG. 1 is a perspective view of the present invention.

As shown in the drawing figures, the present invention comprises: a housing 1, a cable or wire 2 secured to and lockable on the housing 1, a plurality of dials 3 and sleeves 4 rotatably mounted on a bolt means 5 in the housing 1, a control means 6 provided in the housing for locking or unlocking the cable 2 on or from the housing 1, and a combination-changing means 7 for resetting a new combination.

Figure 2:
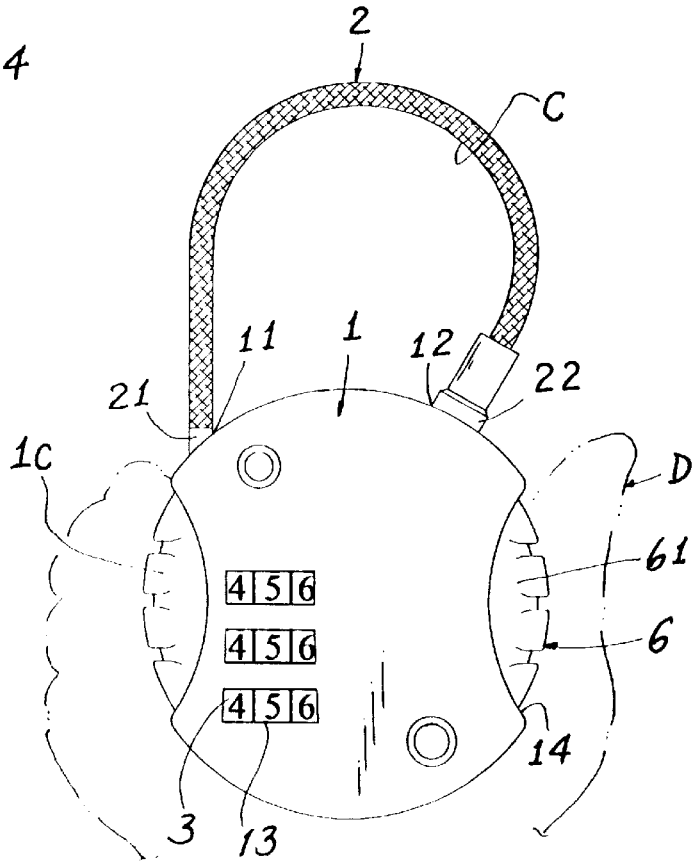
FIG. 2 is a front-view illustration of the present invention.
Figure 3:
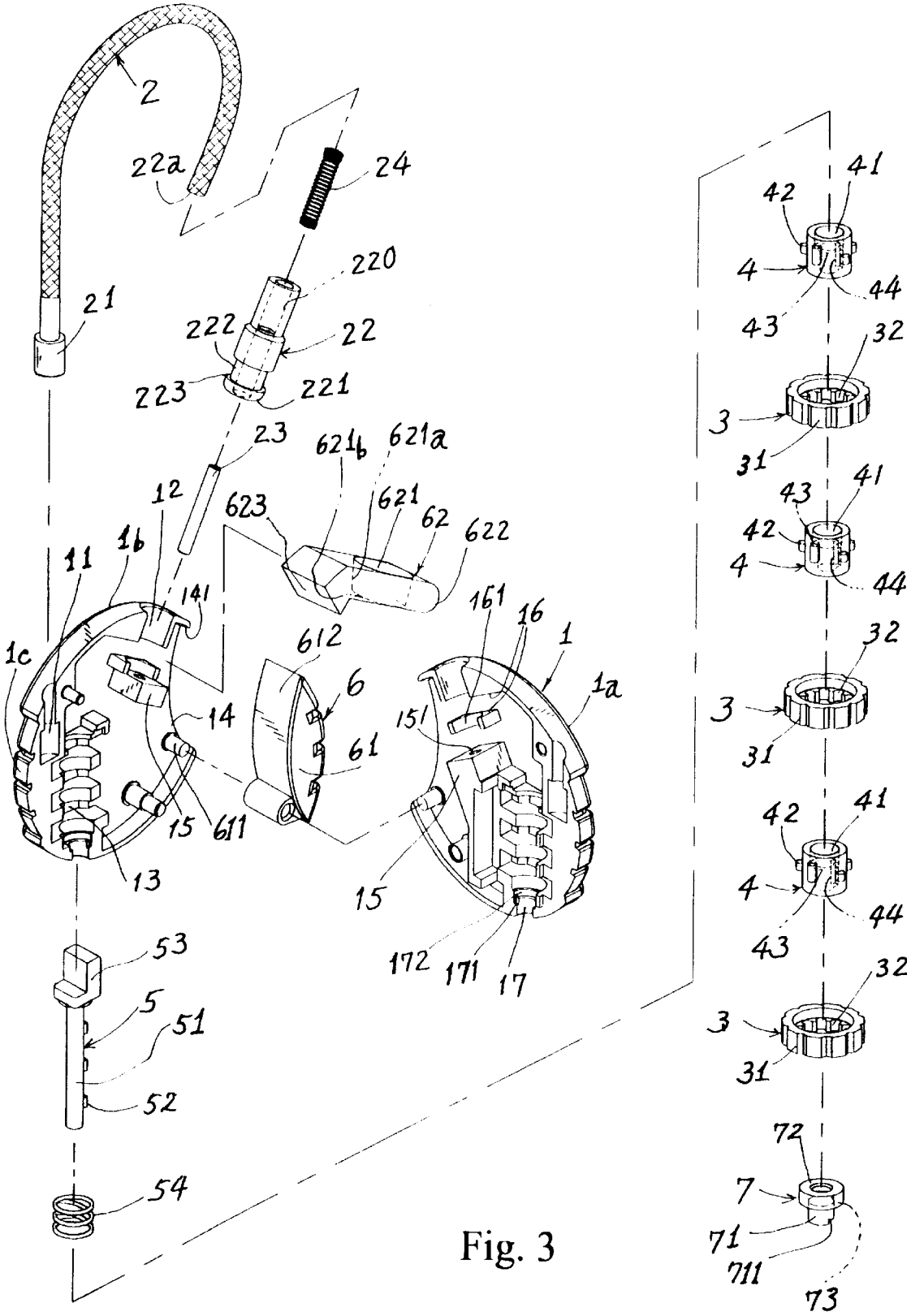
FIG. 3 is an exploded view of the present invention.

The housing 1 is formed by two half shells 1*a*, 1*b* combined together for encasing the elements of the present invention in between the two half shells 1*a*, 1*b*. for symmetric design, and a decorative side portion 1*c* is formed on one side portion of the housing to "simulate" the decorative feature as existing on the other side, namely, on the push button 61 of the control means 6 as shown in FIGS. 1, 2. The housing 1 may be formed as a circular shape as illustrated or as any other shapes, not limited in the present invention. The bolt means 5 has a first longitudinal axis X vertically defined at a longitudinal center of the bolt means 5 located in a first side portion of the housing 1.

Figure 4:
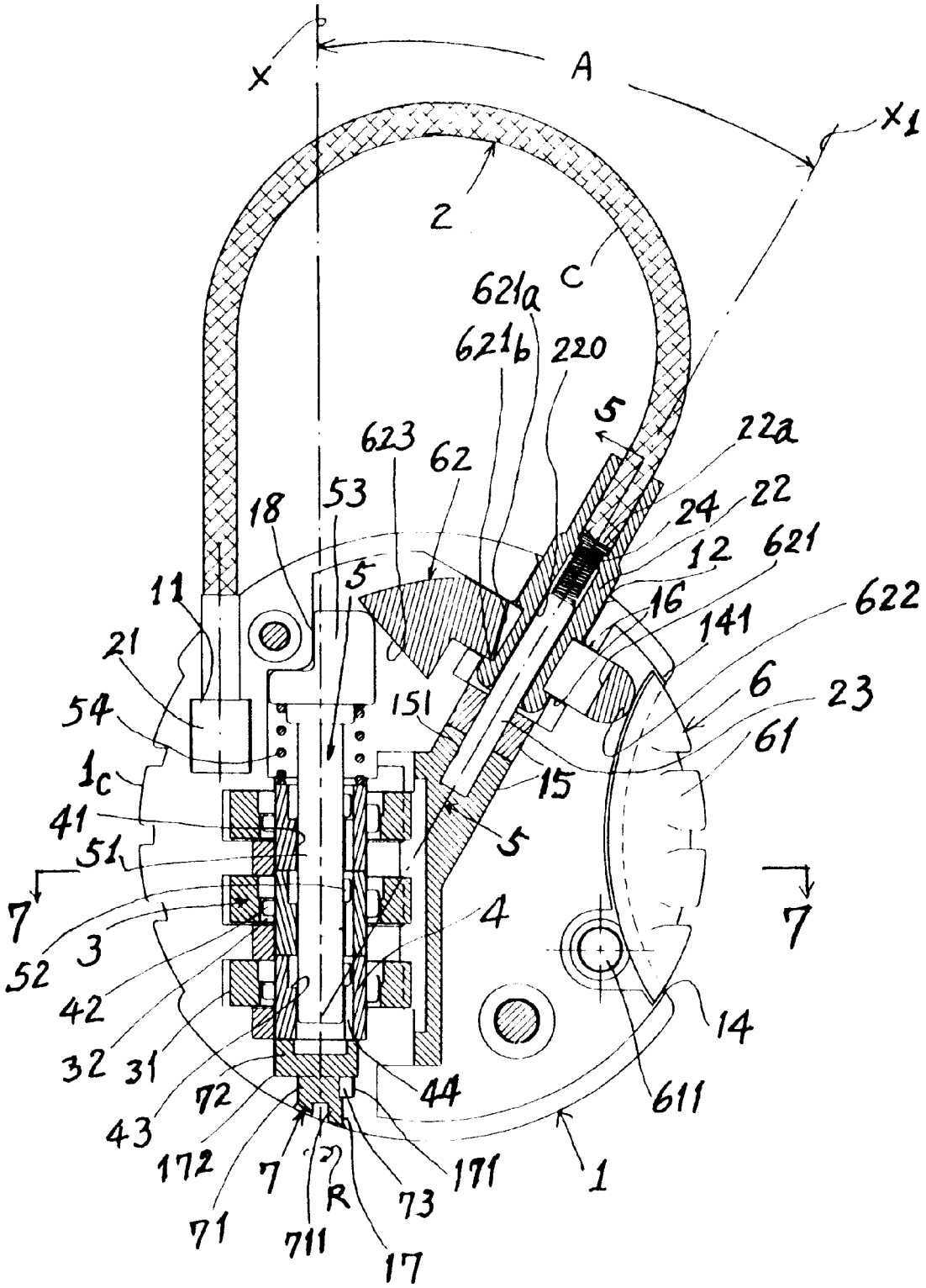
FIG. 4 is a sectional drawing of the present invention ready for unlocking the combination lock.
Figure 7:
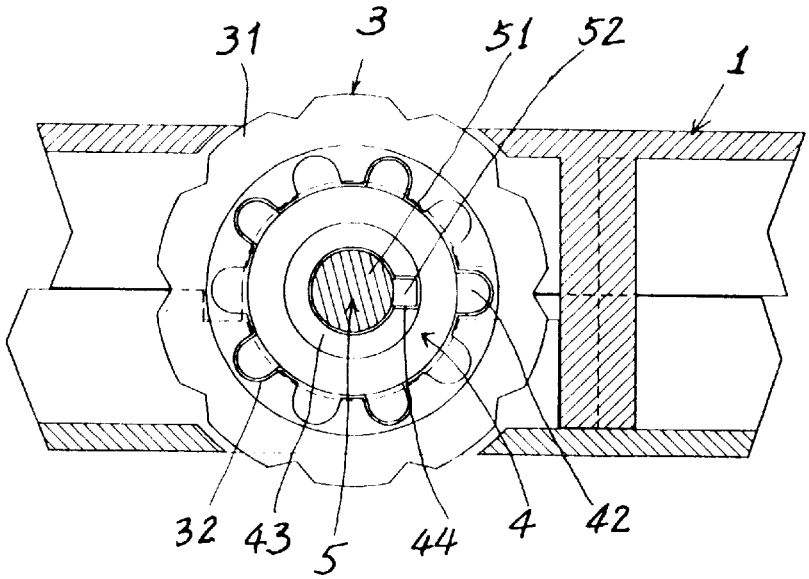
FIG. 7 is a cross sectional drawing of the dial, the sleeve and the bolt of the present invention when viewed from 7—7 direction of FIG. 4.
Figure 5:
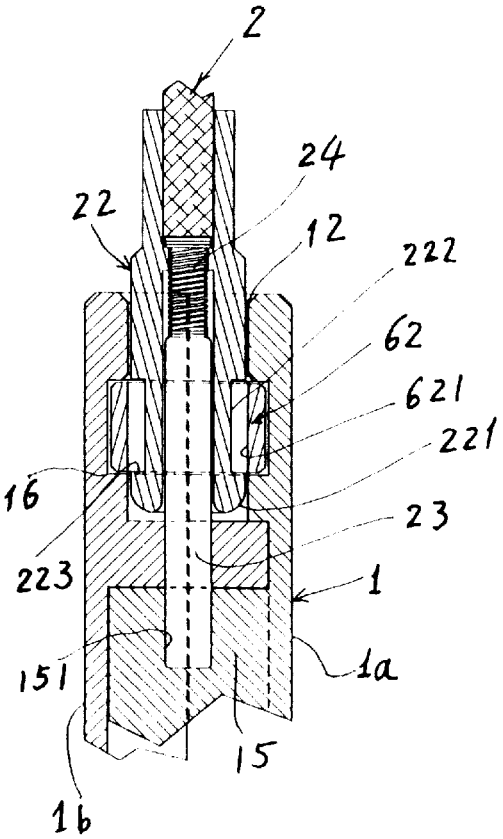
FIG. 5 is a partial sectional drawing when viewed from 5—5 direction of FIG. 4.
Figure 6:
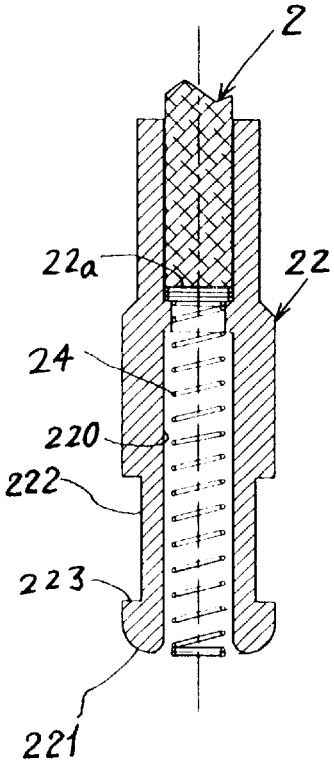
FIG. 6 is a partial sectional drawing of the locking plug of the cable of the present invention.

The housing 1 includes: a first hole 11 formed in a first side portion of the housing for securing a fixed end portion 21 of the cable in the first hole 11, a second hole 12 formed in a second side portion of the housing for inserting and locking a locking plug 22 secured on a movable end portion 22*a* of the cable 2, a plurality of dial windows (or slots) 13 formed in the housing adjacent the first hole 11 for protruding the dials 3 outwardly for convenient rotation of the dials, a button hole 14 formed in the housing adjacent the second hole 12 for protruding the push button 61 of the control means 6 outwardly, a rod holder 15 inclinedly formed in the housing 1 along a second longitudinal axis X1 defined at a center of the second hole 12 and inclinedly formed in a second portion of the housing for fixing a rod member 23 thereon, a guiding groove 16 formed in the housing adjacent the second hole 12 and projectively perpendicular to the second longitudinal axis X1 as shown in FIG. 4, a bottom hole 17 formed in the bottom portion of the housing for installing the combination-changing means 7 in the bottom hole 17, and a vertical guiding groove 18 formed in the housing adjacent the first hole 11 for slidably guiding a head portion 53 of the bolt means 5 in the vertical guiding groove 18.

The second longitudinal axis X1 is separated from the first longitudinal axis X with an acute angle A ranging from 30°~90°, but not limited in the present invention.

The cable 2 has its fixed end portion 21 fixed into the first hole 11 of the housing 1 to be parallel to the first longitudinal axis X about the bolt means 5, and has the locking plug 22 secured on the movable end portion 22*a* of the cable 2 to be inserted in the second hole 12 of the housing about the second longitudinal axis X1 separating from the first axis X with an acute angle A, also defining an acute angle A between the fixed end portion 21 of the cable 2 and the plug 22 when inserted and locked in the housing as shown in FIG. 4.

The locking plug 22 includes: a central hole 220 formed in the plug 22 for retaining an ejecting spring 24 in the central hole 220 and for receiving the rod member 23 into the central hole 220 when the plug 22 is locked in the housing 1, a plug head 221 formed on a bottom portion of the plug 22 having an arcuate bottom surface of the plug head 221, a neck portion 222 circumferentially recessed in the plug 22 to from a locking rim 223 annularly formed between the plug head 221 and the neck portion 222 to be engageable with a sliding actuator 62 of the control means 6 for locking the plug 22 in the housing 1. The rod member 23 will be received into the central hole 220 in the plug 22 to compress the ejecting spring 24 for storing the resilience of the spring 24 when locked.

Each dial 3 includes a ring member 31 having arabic numbers formed thereon, and a plurality of recesses 32 annularly formed in an inside wall of the ring member 31 to be engageable with each protrusion 42 formed on each sleeve 4.

Each sleeve 4 as resiliently coupled with each dial 3 includes: a central hole 41 formed through the sleeve 4 to be rotatably engageable with the bolt means 5, a plurality of protrusions 42 circumferentially formed on a cylindrical outer surface of the sleeve 4 to be engageable with the recess 32 as recessed in the dial 3, an annular retaining portion 43 annularly formed on an inside wall of the sleeve 4 to be engageable with a projection 52 formed on a bolt 51 of the bolt means 5, and a slot 44 formed through the annular retaining portion 43 for passing the projections 52 on the bolt 51 when unlocked.

The bolt means 5 includes: the bolt 51 for rotatably mounting the sleeves 4 and dials 3 thereon about the first longitudinal axis X, a plurality of projections 52 equally spaced and formed on the bolt 51, a head portion 53 formed on a top of the bolt 51 and slidably engageable with the vertical guiding groove 18 formed in the housing 1, and a restoring spring 54 retained between an uppermost sleeve 4 and the head portion 53 for normally urging the head portion 53 of the bolt means 5 upwardly to allow the head portion 53 to urge the sliding actuator 62 outwardly for locking the plug 22 and to urge the push button 61 outwardly ready for depression on the push button 61 when unlocking the lock.

The control means 6 includes: a push button 61 pivotally or angularly secured in the housing about a pivot 611 and having a depression portion 612 formed on an upper portion of the push button, said push button 61 protruding outwardly from a button hole 14 formed in the second side portion of the housing; and a sliding actuator 62 slidably held in the guiding groove 16 inclinedly formed in the housing adjacent the second hole 12 of the housing 1, having a central hole 621 formed through the sliding actuator 62 for passing the plug 22 therethrough for locking the plug 22 with the actuator 62, a follower portion 622 formed on an outer portion of the actuator 62 preferably made with an arcuate surface thereon to be contacted with the depression portion 612 of the push button 61, and a thrusting block 623 formed on an inner portion of the actuator 62 opposite to the follower 622 having a sloping surface formed on a bottom of the thrusting block 623 for depressing the bolt means 5 downwardly when unlocking the lock as driven by the push button 61 (FIG. 4 to FIG. 8). The central hole 621 in the sliding actuator 62 includes a sloping surface 621*a* sloping downwardly to form a locking edge portion 621*b* on a bottom edge of the central hole 621 for engaging the locking rim 223 for locking the plug 22 (FIG. 9).

The rod holder 15 is formed with a rod hole 151 for inserting the rod member 23 therein, with the rod member 23 aligned with the second longitudinal axis X1.

A plug hole 161 is formed in the housing 1 following the second hole 12 for passing the plug 22 downwardly to be locked with the actuator 62 in the housing 1.

For unlocking the present invention, the dials 3 and sleeves 4 are rotated to the unlocking combination to align the projections 52 on the bolt 51 with the slots 44 of the sleeves 4 as shown in FIG. 4. Upon depression (D) of the push button as shown in FIG. 8 to depress the sliding actuator 62 inwardly to allow the thrusting block 623 of the actuator 62 to downwardly depress the head portion 53 of the bolt means 5 to disengage the locking edge portion 621*b* on the actuator 62 from the locking rim 223 on the plug 22, the ejecting spring 24 as urged against the rod member 23 will eject the plug 22 outwardly from the second hole 12 to unlock the cable 2 of the present invention (FIG. 8).

When locking the present invention, the dials 3 are rotated to a locking combination as shown in FIG. 9 to allow the annular retaining portion 43 in each sleeve 4 to retard the projection 52 on the bolt 51 from a downward movement of the bolt 51. The head portion 53 on the bolt 51 will retard the thrusting block 623 to ensure the engagement of the locking edge portion 621*b* of the actuator 62 with the locking rim 223 of the plug 22. Upon an inward depression as dotted line shown in FIG. 9, the actuator 62 will not be moved since the thrusting block 623 has been retarded against the head portion 53 of the bolt means 5 to thereby lock the plug 22 of the cable 2 in the housing 1.

The combination-changing means 7 (FIGS. 4, 10) includes: a driving knob 71 rotatably engageable with a bottom hole 17 formed in the bottom of the housing 1 and having a bottom recess 711 recessed in the knob 71, a ring portion 72 annularly formed above the driving knob 71 and rotatably engageable with an arcuate seat portion 172 arcuately formed in the housing above the bottom hole 17, and a positioning extension 73 formed on the driving knob 71 and normally rested in a notch 171 recessed in an inside wall of the bottom hole 17 and operatively retained on the arcuate seat portion 172 (FIG. 10) when the driving knob 71 is raised and rotated (R) at a right angle (or other suitable angles) to raise the sleeves 4 upwardly (FIG. 4 to FIG. 10) to disengage the sleeves 4 from the dials 3 to allow a free rotation of the dials for resetting a new unlocking combination (the projections 52 still engaged with the slots 44 in the sleeves 4 for stabilizing the sleeves 4 when free rotating the dials 3). A coin or driver (not shown) may be used to insert in the recess 711 for rotating the knob 71.

Figure 8:
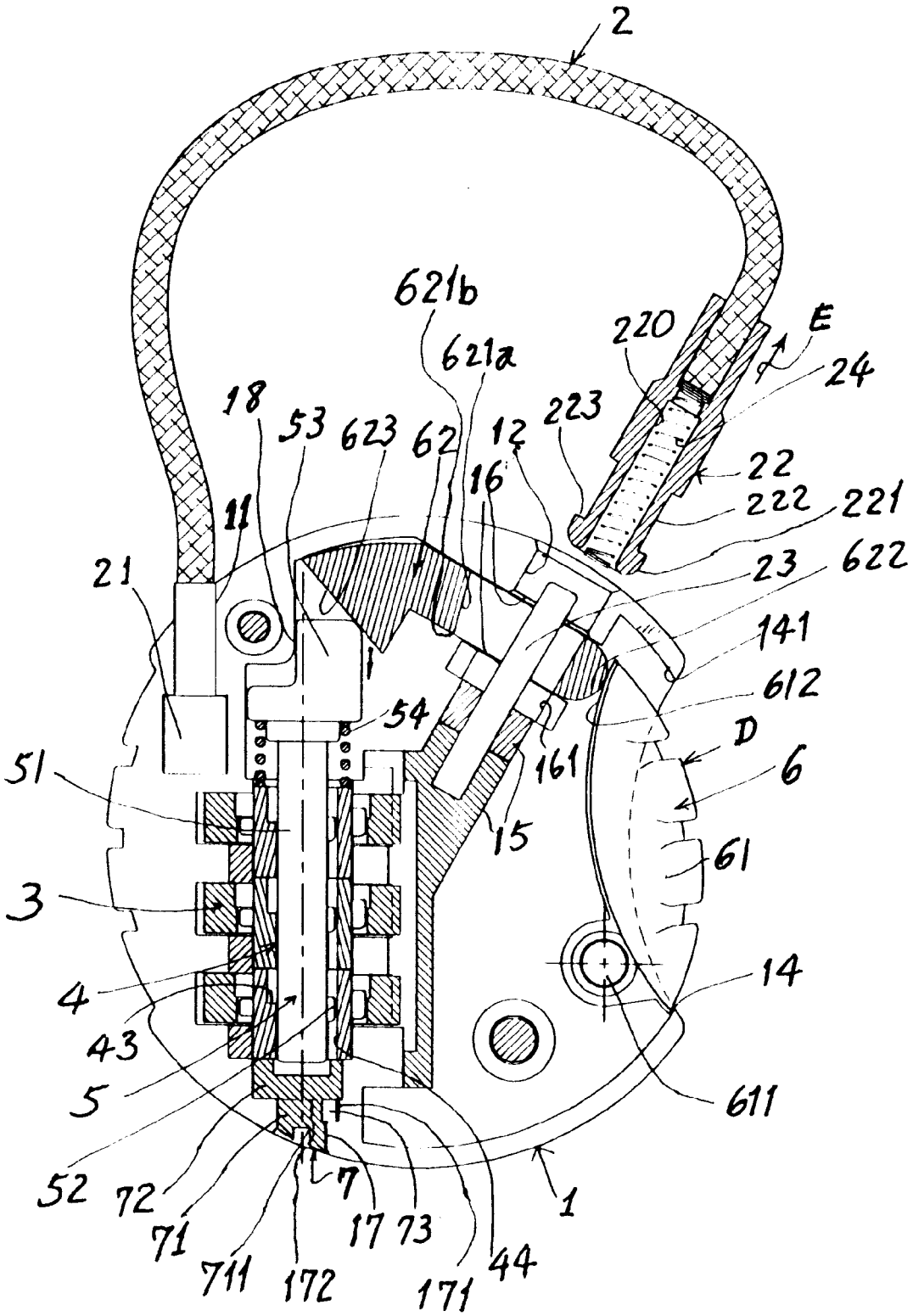
FIG. 8 is a sectional drawing of the present invention as unlocked from FIG. 4.
Figure 9:
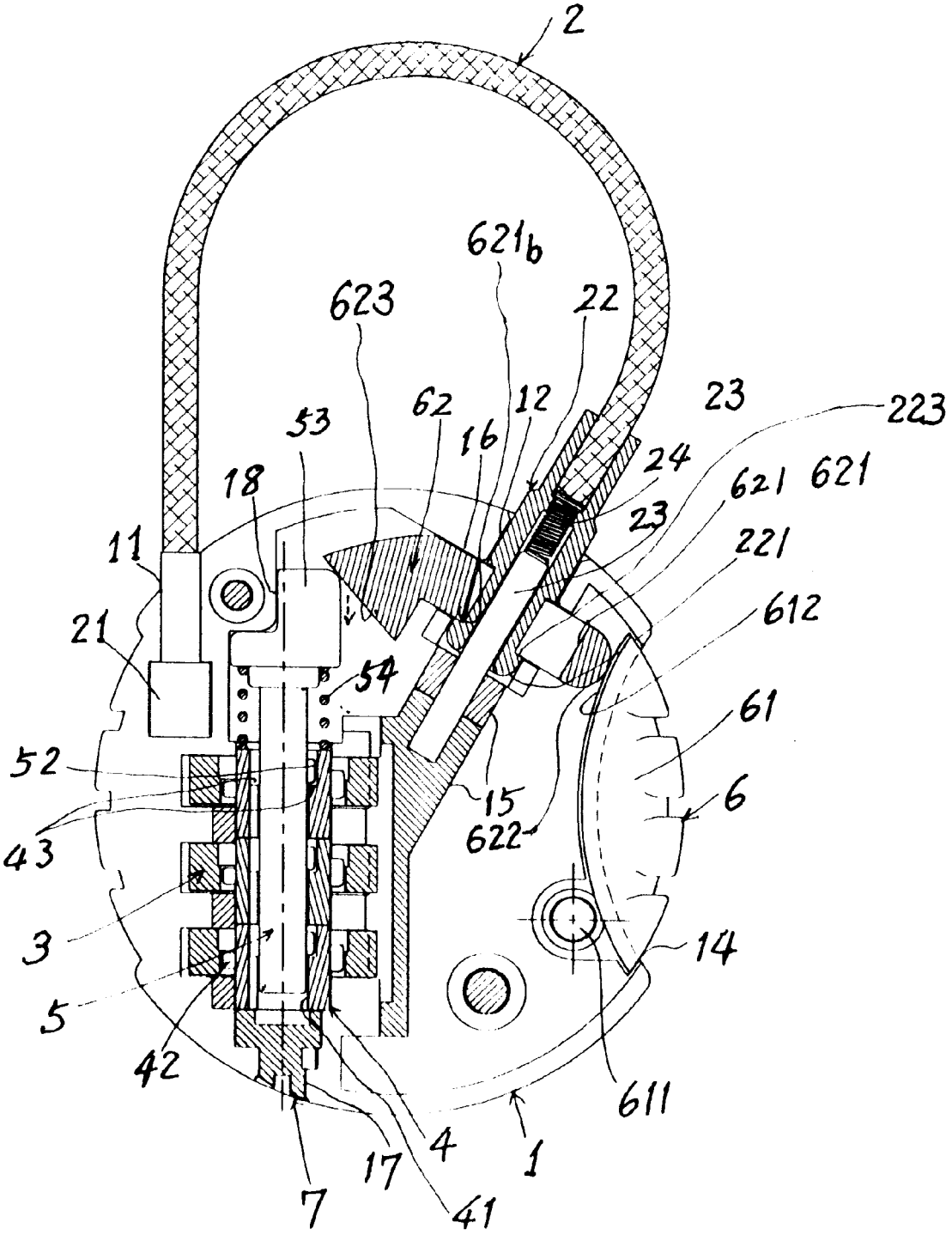
FIG. 9 shows a locked state in accordance with the present invention.
Figure 10:
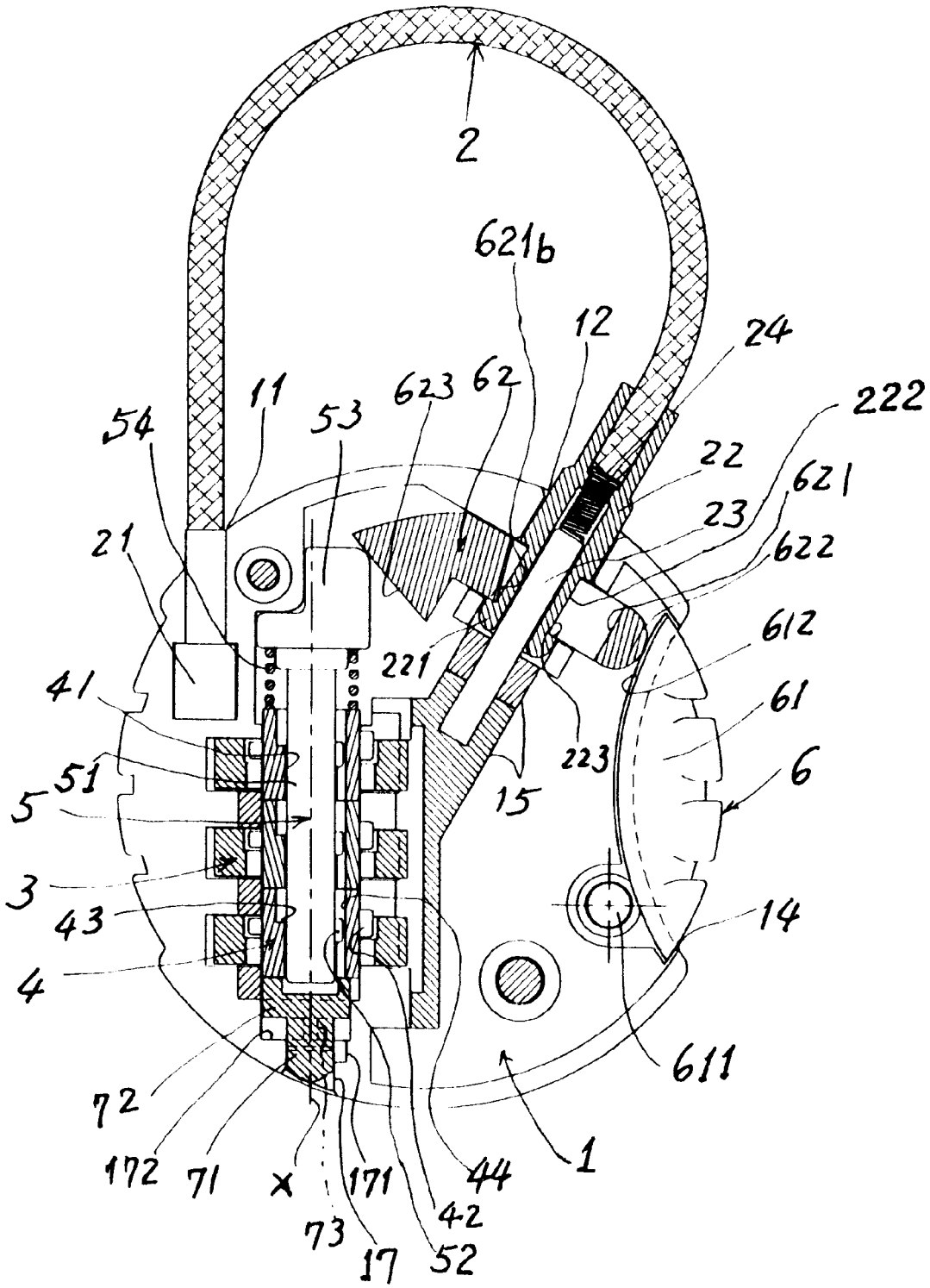
FIG. 10 shows the lock when changing a combination in accordance with the present invention.

After finishing the setting of new combination, the driving knob 71 is rotated reversely to re-align the positioning extension 73 with the notch 171 and the spring 54 will urge the sleeves 4 downwardly to be engaged with the dials 3 for the coupling rotation of the dials 3 with the sleeves 4, which are rotated for disengaging the projections 52 on bolt 51 from the slots 44 in the sleeves 4 for locking the present invention (FIG. 4 or 8 to FIG. 9).

The sloping surface 621*a* formed on a side wall of the central hole 621 of the sliding actuator 62 will be thrusted inwardly by the plug head 221 when locking the plug 22 into the second hole 12 in the housing 1. Then, the locking rim 223 is engaged with the locking edge portion 621*b* of the actuator 62 as urged by the spring 54 of the bolt means 5, thereby locking the plug 22 of the cable 2 in the housing 1.

The present invention is superior to the prior art with the following advantages:

1. After rotating the dials 3 to the correct unlocking combination, the lock can be conveniently unlocked by a user's single hand as shown in FIG. 2 just simply depressing the push button 61.

2. The plug 22 of the free cable end is inserted into or ejected from the hole 12 formed in an upper portion of housing 1 so that the cable 2 will not interfere or obstruct the depression of the push button 61 for ergonomically unlocking or locking the lock.
3. The elements of the locking mechanism including the plug 22, the cable 2, the rod member 23, the sliding actuator 62, the bolt 51 and the push button 61 are mutually arranged in angular relationship (FIG. 4) for the ergonomic unlocking and locking operation, while causing no conflict for implementing the relevant elements in angular relationship in such a compact space within the housing 1. The acute angle A between the two cable ends 21, 22 of the cable makes the two cable ends 21, 22 convergently contracted into the housing 1, while diverging the outer loop portion C of the major cable portion of the cable 2 outwardly upwardly to provide a big space enough for locking many articles (such as a plurality of certificates, cards, or other miniature articles) in series on the cable 2.

The acute angle may range from 30 to 90 degrees, but preferable from 30 to 45 degrees.

The present invention may be modified without departing from the spirit and scope of the present invention.

I claim:

1. A cable combination lock comprising:

a housing;

a cable having a fixed end portion thereof fixed in a first hole formed in a first side portion of said housing, and having a locking plug secured on a movable end portion of said cable insertable and lockable in a second hole formed in a second side portion of said housing opposite to said first hole;

a plurality of dials and sleeves, each said dial resiliently coupled with each said sleeve, rotatably mounted on a bolt means longitudinally disposed in said housing adjacent to said first hole, having a first longitudinal axis defined at a longitudinal center of said bolt means, said fixed end portion of said cable parallel to said first longitudinal axis; and a control means including a push button pivotally secured in said housing and normally protruding outwardly through a button hole formed in the second side portion of said housing ready for depression thereon, and a sliding actuator normally contacted with said push button and slidably held in said housing adjacent to said second hole for locking said locking plug of said cable when locking the combination lock;

said locking plug inserted in said second hole of said housing, having a second longitudinal axis defined at a center of said second hole to be separated from said first longitudinal axis with an acute angle ranging from 30~45 degrees, with said locking plug when inserted and locked in said second hole separating from said fixed end portion of said cable with said acute angle; whereby upon depression of said push button, said sliding actuator will be inwardly driven by said push button to downwardly depress said bolt means to disengage said locking plug from said sliding actuator for unlocking said plug of said cable from said housing;

said locking plug including: a plug head formed on a bottom portion of said plug, a locking rim formed in between said plug head and a neck portion recessed in said plug, and an ejecting spring retained in a central hole formed in said plug; said plug, when inserted into said second hole in said housing, having said central hole of said plug operatively receiving a rod member inclinedly secured in said housing and forming said acute angle as separated from said first longitudinal axis to allow said rod member to compress said ejecting spring within said plug for storing the resilience of the ejecting spring; whereby upon engagement of said locking rim of said plug with said sliding actuator when inserting said plug in said second hole, said plug will be locked with said sliding actuator in said housing; and upon disengagement of said sliding actuator from said locking rim, said plug will be resiliently ejected by said ejecting spring as retained on said rod member; and said push button including a depression portion formed on an upper portion of said push button to be normally contacted with a follower portion formed on an outer portion of said sliding actuator; said sliding actuator slidably held in said housing having a central hole formed in said actuator for passing said plug through said central hole for locking said plug with said actuator which is held between said push button and said bolt means.

2. A cable combination lock according to claim 1, wherein said bolt means includes a bolt having said plurality of sleeves rotatably mounted on said bolt about said first longitudinal axis; a plurality of projections equally spaced and formed on said bolt, each said projection retained on an annular retaining portion formed on an inside wall of each said sleeve for retarding a downward movement of said bolt for locking said sliding actuator and said plug, and each said projection operatively passing through a slot formed through the annular retaining portion on said sleeve when unlocking the combination lock; a head portion formed on a top of said bolt having a restoring spring retained between said head portion and an uppermost sleeve for resiliently urging said sliding actuator for locking said plug with said sliding actuator.

3. A cable combination lock according to claim 1, wherein said sliding actuator includes a thrusting block formed on an inner portion of said actuator having a sloping surface formed on a bottom of said thrusting block for depressing the bolt means downwardly when unlocking the combination lock.

4. A cable combination lock according to claim 1, wherein said sliding actuator includes a sloping surface sloping downwardly on a side wall of said central hole, and a locking edge portion formed on a bottom edge of the central hole for engaging the locking rim of said plug when locking the combination lock.

5. A cable combination lock according to claim 1, wherein said sliding actuator is slidably held in a guiding groove formed in said housing to be projectively perpendicular to said second longitudinal axis.

6. A cable combination lock according to claim 1, wherein said combination lock further comprises a combination-changing means including: a driving knob rotatably engageable with a bottom hole formed in a bottom of the housing, a ring portion annularly formed above the driving knob and rotatably engageable with an arcuate seat portion arcuately formed in the housing above the bottom hole, and a positioning extension formed on the driving knob and normally rested in a notch recessed in an inside wall of the bottom hole and operatively retained on the arcuate seat portion when the driving knob is raised and rotated at an angle to raise the sleeves upwardly to disengage the sleeves from the dials to allow a free rotation of the dials for resetting a new unlocking combination.

* * * * *